US010060087B2

(12) United States Patent
Smith

(10) Patent No.: US 10,060,087 B2
(45) Date of Patent: Aug. 28, 2018

(54) FULLY ADJUSTABLE SUSPENDED POST AND PANEL MODULES AND INSTALLATION METHODS

(71) Applicant: Rodney I. Smith, Midland, VA (US)

(72) Inventor: Rodney I. Smith, Midland, VA (US)

(73) Assignee: EASI-SET WORLDWIDE, Midland, VA (US)

( * ) Notice: Subject to any disclaimer, the term of this patent is extended or adjusted under 35 U.S.C. 154(b) by 0 days.

(21) Appl. No.: 15/050,610

(22) Filed: Feb. 23, 2016

(65) Prior Publication Data

US 2017/0241088 A1 Aug. 24, 2017

(51) Int. Cl.

*E01F 8/00* (2006.01)
*E02D 29/02* (2006.01)
*E04G 25/04* (2006.01)

(52) U.S. Cl.

CPC ..... *E01F 8/0023* (2013.01); *E01F 8/0017* (2013.01); *E02D 29/0266* (2013.01); *E04G 25/04* (2013.01)

(58) Field of Classification Search

CPC ... E04B 1/043; E04B 1/61; E04B 1/04; E04B 2103/02; E04C 2/30; E04C 2/288; E04C 2/06

USPC ..... 52/309.12, 309.15, 309.17, 582.1, 586.1

See application file for complete search history.

(56) References Cited

U.S. PATENT DOCUMENTS 1,467,470 A 9/1923 Borg
1,544,863 A 7/1925 Ross
3,583,666 A * 6/1971 Horstketter ..... E04G 11/28 249/10
3,991,532 A 11/1976 Buxborn
4,068,427 A * 1/1978 Camardo ..... E04G 21/26 52/127.2
4,386,762 A * 6/1983 Collins ..... E04H 17/22 256/59
4,434,600 A 3/1984 Backman
4,519,729 A 5/1985 Clarke et al.
4,605,090 A * 8/1986 Melfi ..... E01F 8/0017 181/210
4,838,524 A * 6/1989 McKeown ..... E01F 8/0011 181/210
4,887,691 A * 12/1989 Rotondo ..... E01F 8/0023 181/210
5,134,815 A 8/1992 Pickett
5,218,797 A 6/1993 Kruse
5,426,267 A * 6/1995 Underhill ..... E01F 8/0011 181/210
5,501,057 A 3/1996 Dawson
5,524,405 A 6/1996 Byrd
5,689,927 A 11/1997 Knight, Sr.
5,887,404 A 3/1999 Kreizinger
6,000,182 A 12/1999 Keenan (Continued)

FOREIGN PATENT DOCUMENTS

JP 59224727 A 12/1984

*Primary Examiner* — Brian E Glessner
*Assistant Examiner* — Adam G Barlow
(74) *Attorney, Agent, or Firm* — Whitham & Cook, P.C.

(57) ABSTRACT

A wall module for a modular wall structure integrates a wall panel portion with a post portion having bottom extensions and at least one groove for receiving a distal end portion of a wall panel portion of an adjacent module. The bottom post extension may be suspended in a post hole and anchored with a material such as concrete.

16 Claims, 10 Drawing Sheets

(56) References Cited

U.S. PATENT DOCUMENTS

| | | | | |
|---|---|---|---|---|
| 6,299,142 | B1 | 10/2001 | Chaney et al. | |
| 6,609,347 | B2 | 8/2003 | Morrow | |
| 7,802,409 | B2 | 9/2010 | Stott | |
| 7,980,034 | B2 * | 7/2011 | Fehr | E04C 3/30 248/519 |
| 8,056,299 | B2 * | 11/2011 | Liskey | E02D 27/12 405/233 |
| 8,407,956 | B2 | 4/2013 | Smith | |
| 8,607,518 | B2 | 12/2013 | Smith | |
| 2002/0184848 | A1 | 12/2002 | Dowland | |
| 2003/0197161 | A1 * | 10/2003 | Brown | E04H 17/1434 256/1 |
| 2006/0179728 | A1 * | 8/2006 | Lang | E04G 21/26 52/127.2 |
| 2011/0067341 | A1 * | 3/2011 | Smith | E02D 29/02 52/582.1 |

* cited by examiner

FULLY ADJUSTABLE SUSPENDED POST AND PANEL MODULES AND INSTALLATION METHODS

FIELD OF THE INVENTION

The present invention generally relates to wall panels and, more particularly, to prefabricated wall panels for uses such as acoustic barriers along highways, retaining walls, and in other applications. The present invention further relates to methods of installing the same.

BACKGROUND OF THE INVENTION

Population growth of cities and towns in recent years has caused residential and commercial development of large areas of land around such cities and towns. Increased densities and speeds of traffic have thus been necessitated for travel to and within such areas, requiring many new roadways or roadway improvements (e.g., additional roadway lanes) while increased population density and land values have required utilization of land which often abuts major traffic thoroughfares where relatively high levels of noise are present. Such noise will often be communicated to nearby properties where the noise may interfere with desired uses of such property.

In recent years, walls have been constructed to function as acoustic baffles or barriers in an effort to reduce noise levels at locations adjacent to roadways where commercial, high density and/or high speed traffic is present. Such walls must be sturdily built of materials which are not easily damaged by weather conditions such as high winds or by possible impact from vehicles. The walls must also be relatively tall (e.g., eight feet to thirty feet or more) and must be securely anchored, requiring support posts to be of extreme length, generally twenty-five feet greater than the wall height or fastened to reinforced concrete caissons extending to a twenty-five foot or greater depth in the ground. Such a fastening has generally been accomplished by having large bolts embedded in or attached to the caisson using a flange and a complementary flange affixed to the post which can thus be affixed to the caisson below grade level and the connection then encapsulated with concrete to fill the remainder of the post hole above the caisson. Both the provision of a flange of sufficient robustness and the attachment of the post to the caisson contribute substantially to the overall cost of the wall system. Moreover, such structures and operations also required the posts to be installed several days prior to the installation of the wall sections (usually provided as panels of a standard height which are then essentially stacked edge-to-edge in grooves in the posts) in order for the concrete fill to cure adequately to carry loads imposed by the wall segments and their installation. Thus the installation of posts and installation of wall panel segments in separate operations increases the duration of construction time, the amount, types, and movement of machinery required and the amount of labor involved, further contributing to cost of such walls. Further, such large structures may be required for both sides of substantial lengths of roadway and can thus add significantly to costs of roadway construction or improvement.

These factors favor construction of such barriers from large standardized wall panels of pre-cast concrete which are supported in grooves of some construction such as wide flanged or H-shaped steel beams which are anchored securely in the ground. However, for aesthetic as well as maintenance cost reasons, cast concrete posts having opposing grooves to receive the wall segments have been favored in recent years even though difficulties are presented in providing such opposed grooves of sufficient strength and accuracy.

In any case, somewhat different machinery has been required to anchor the posts in the ground with highly accurate spacing to receive ends of wall panels and to assemble the wall panels to them in separate operations. Further, if damage or settling occurs, the posts could shift and possibly allow the wall panels to become detached therefrom, particularly where wall panels of standardized size are stacked edge-to-edge, as alluded to above. Moreover, when a wall is built on terrain which is other than flat, such as where a grade is present, the bottom-most wall panels will generally reach the ground at only one corner, causing unbalanced and uncontrolled stresses in the wall which are transferred to the posts, aggravating any shifting which may occur and possibly causing wall failure.

SUMMARY OF THE INVENTION

As an aspect of some embodiments, there is provided a wall section or module with integrated post and panel wherein the post portion is extended beyond the top of the wall panel portion by a distance sufficient to accommodate the terrain elevations on which a wall is built using the integrated post and panel sections in accordance with the invention and beyond the bottom of the wall panel portion by a length sufficient for support of the wall section even if shifting or settling occurs.

As a further aspect of some embodiments, there is provided a wall section or module which minimizes unbalanced stresses transferred to posts and/or adjacent wall sections.

As yet a further aspect of some embodiments, there is provided an integrated post and panel structure which allows the construction of a wall in a single set of operations at the location of each respective post and panel structure location.

In some embodiments, a module for construction of a wall is provided comprising a panel portion integrally formed with a post portion. The wall module may include a groove for receiving a distal end of a panel portion of an adjacent module, a top post extension for accommodating the entirety of the distal portion of the panel portion of the adjacent module when the module and the adjacent module are installed at different heights, and a bottom post extension of a length sufficient to support the module in soil. In some embodiments, the bottom post extension is integrated with a pier or caisson.

In accordance with another aspect of the some embodiments, a modular wall comprising a plurality of wall modules is provided, each wall module comprising a panel portion integrally formed with a post portion. In some embodiments, the post portion includes a groove for receiving a distal end of a panel portion of an adjacent module, a top post extension for accommodating said distal portion of said panel portion of said adjacent module when said adjacent module and said module are installed at different heights, and a bottom post extension. In some embodiments, the modular wall further comprises a caisson or pier integrated with the bottom post extension of the wall module which is of a length sufficient to support the wall module in soil.

In accordance with a further aspect of some embodiments, a method of constructing a modular wall is provided including steps of forming a post hole to a desired depth, positioning a wall module comprising a panel portion integrally formed with a post portion including a groove for receiving a distal end of a panel portion of an adjacent module, and a bottom post extension such that said bottom post extension is of a length sufficient to support the wall module in soil and said distal end of said wall portion is received in said groove of an adjacent module, and pouring a material to encapsulate the bottom extension portion of the wall module.

In accordance with a further aspect of some embodiments, a method of constructing a modular wall is provided using wall modules comprising a panel portion integrally formed of a rigid material with and cantilevered from a post portion. A wall module is positioned on top of one or more load bearing members arranged under the panel portion, the one or more load bearing members vertically supporting the wall module at a sufficient height to suspend a distal end of the post portion of the wall module within a post hole. Material (e.g., concrete) is poured into the post hole such that the material fills space between the distal end of the post portion and a bottom of the post hole and spaces between sides of the post portion and sides of the post hole.

BRIEF DESCRIPTION OF THE DRAWINGS

The foregoing and other objects, aspects, and advantages will be better understood from the following detailed description of exemplary embodiments and features with reference to the drawings, in which.

DETAILED DESCRIPTION

Figure 1:
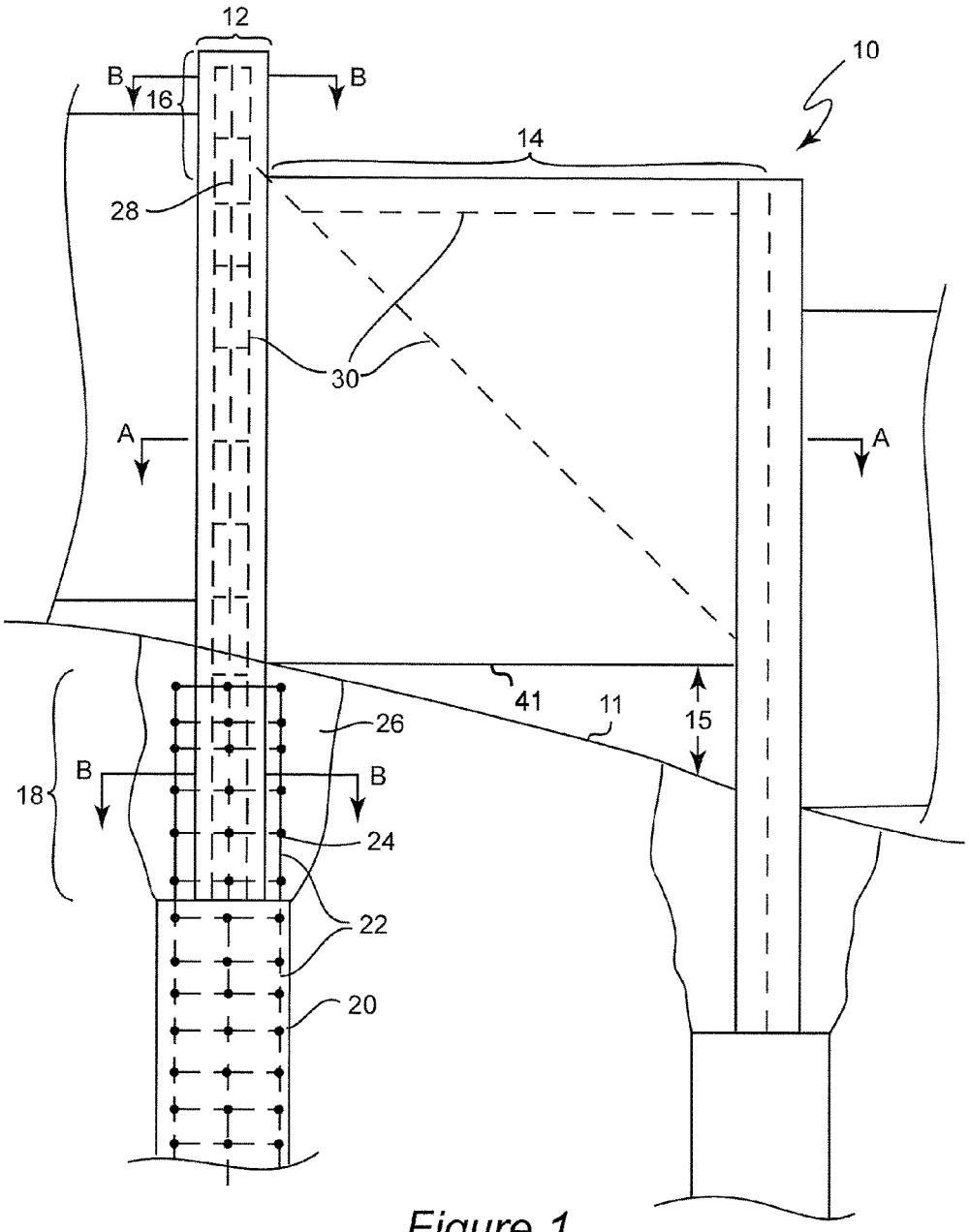
FIG. 1 is an elevation view of an integrated wall and post section in accordance with the invention as assembled with another wall and post section in a completed wall.
Figure 2:
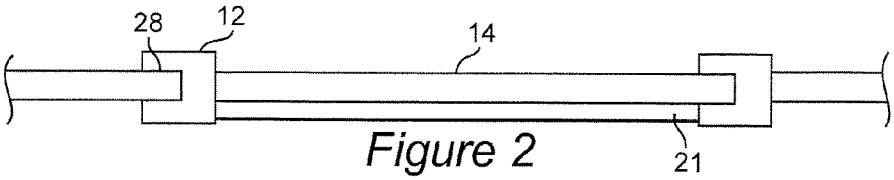
FIG. 2 is a top view of an integrated wall and post section in assembled with an adjacent integrated wall and post section in accordance with the invention.

Referring now to the drawings, and more particularly to FIGS. 1 and 2, there are shown, respectively, elevation and top views of an integrated post and panel section/module 10 as assembled with adjacent post and panel sections or modules in a completed wall. While exemplary embodiments illustrated in the figures will be described in connection with an application as an acoustic barrier in which application it is deemed to be particularly advantageous, it should be understood that the principles of the invention may be embodied in numerous ways and with modifications which may be more or less specific to other particular applications such as retaining walls or even habitable or storage structures. In this regard, the panel section may have any decorative and/or sound absorbing coating or material layer or any other surface treatment 21 applied thereto or integrated therewith, as depicted in FIG. 2, to enhance appearance or performance of the module 10 or structure formed therefrom, in accordance with the intended use of the structure.

A post and panel structure or module 10 principally comprises an integrated panel section and post section for a wall. The post section is sometimes referred to as including a bottom post extension 18 which is defined as the segment of the post portion which extends past a bottommost edge 41 of the panel portion up to a distal end of the post portion. The distal end of the post portion is the end which extends furthest into the ground after installation.

In some but not all embodiments, the bottom post extension 18 may be embedded in and thus integrated with a pier or caisson. When assembled with other similar sections or modules, a module 10 forms a wall of enhanced strength and structural robustness which greatly reduces transfer of uncontrolled forces to other wall sections and to posts and which can be transported and assembled in a substantially continuous process which can be performed with high efficiency and much reduced cost compared with other modular wall systems in which the post and wall panel portions are not integrated. Specifically, in accordance with exemplary embodiments described herein, only a single basic shape of module is used although the modules can be varied in dimensions and some details as circumstances or a given wall design, site, or installation may require as will be discussed in greater detail below.

Figure 4:
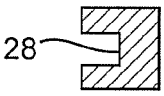
FIG. 4 is a cross-sectional view of the post portion extensions of a single integrated wall and post section in accordance with the invention at either of sections B-B shown in FIG. 1.
Figure 3:
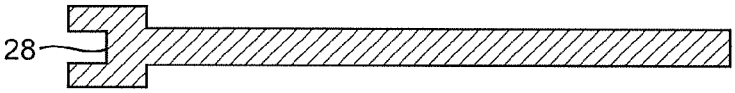
FIG. 3 is a cross-sectional view of a single integrated wall and post section in accordance with the invention at section A-A indicated in FIG. 1.
Figure 5:
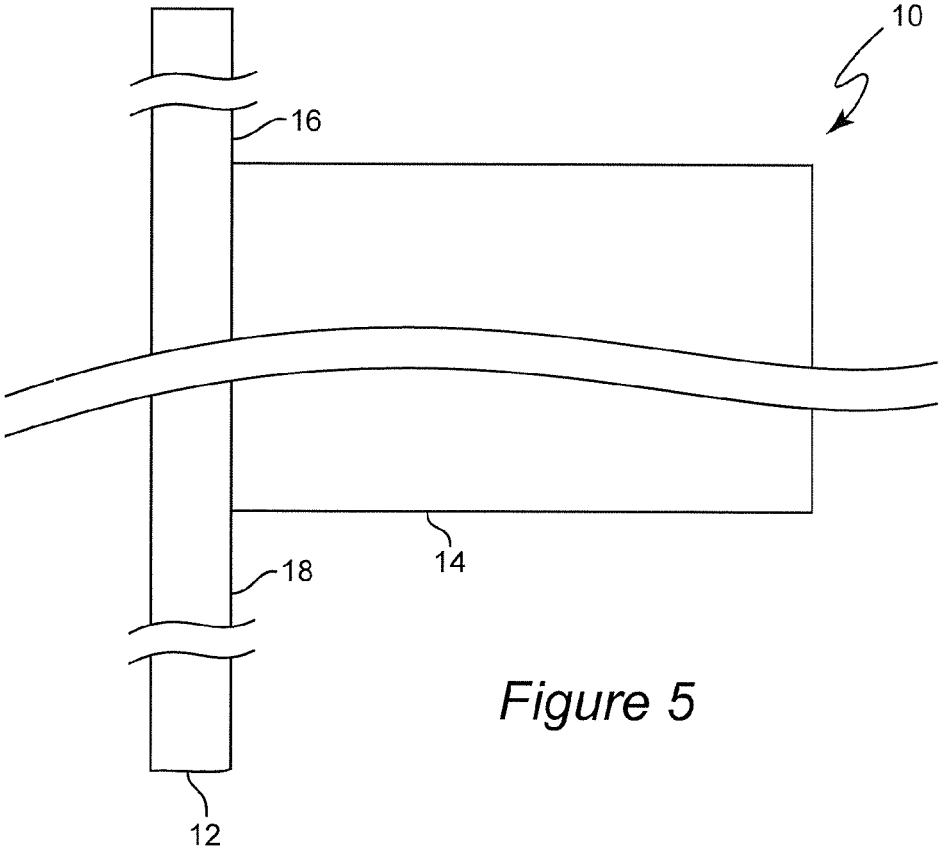
FIG. 5 is an elevation view of a single integrated wall and post section in accordance with the invention.
Figure 6:
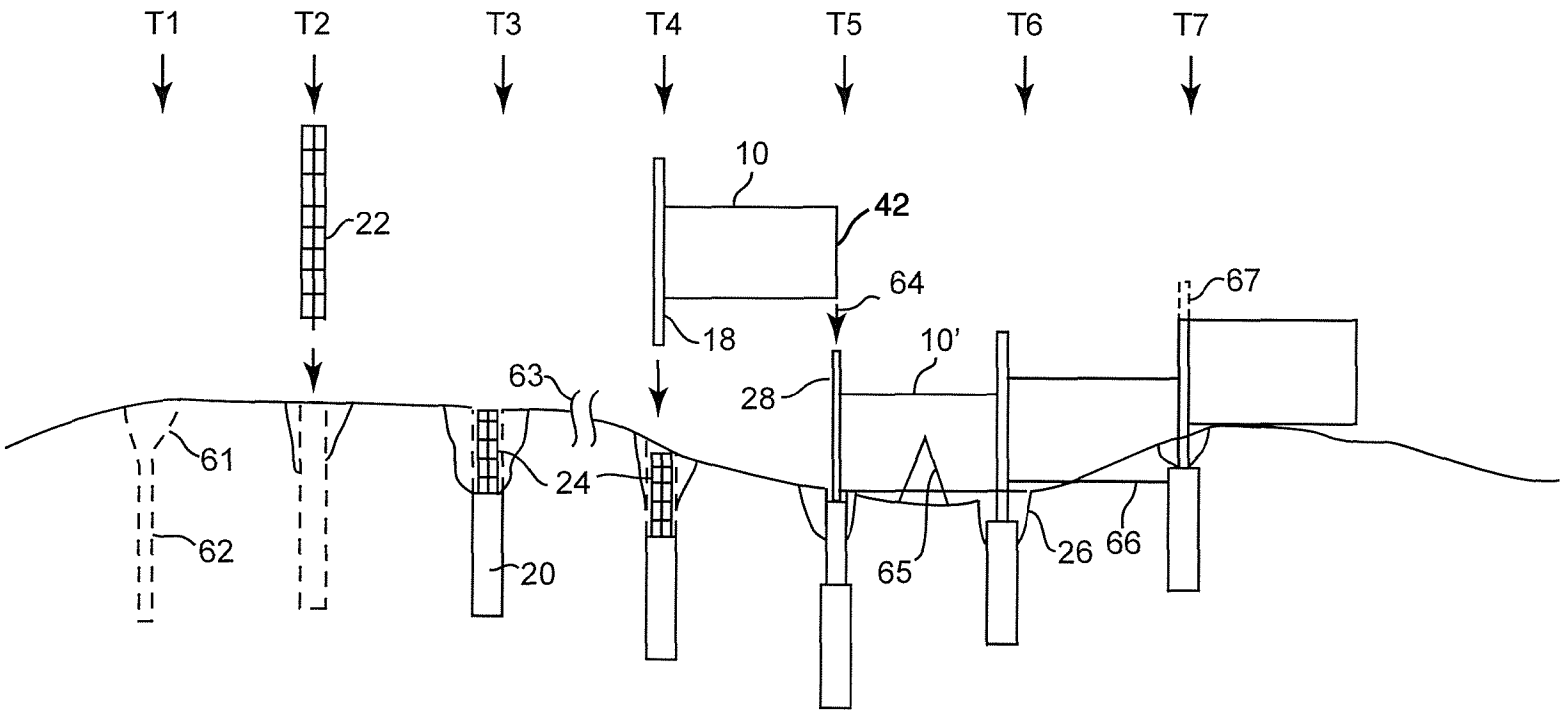
FIG. 6 illustrates construction of a wall using the integrated post and panel sections or modules in accordance with the invention such that installation can be accomplished with a single series of operations at each post and panel location.

In the elevation view of FIG. 1, the overall shape of the integrated post and panel module 10 somewhat resembles a flag flying from a flagpole or a "T" shape turned on its side, as is most evident in the depiction of FIG. 5 and in FIG. 6. Specifically module 10 comprises a post portion 12 and a panel portion 14 which are integrally formed of a one-piece construction that is preferably cast from concrete or concrete-bonded aggregate or the like for strength and resistance to weather and impact damage. In many exemplary embodiments, the post portion 12 includes a single groove 28 along at least the upper portion thereof but preferably over its entire length, as illustrated in the cross-sections illustrated in FIGS. 3 and 4, and extensions 16, 18 at the top and bottom of module 10 which extend for a distance beyond the top and bottom of the panel portion 14.

The length of the extension 16 (also referred to herein as top post extension 16) is in some installation sites somewhat arbitrary (e.g., where the terrain is substantially level). The length of extension 16 is preferred to be at least equal to the maximum change in grade 11 per "post-to-post" distance (e.g., effective installed horizontal module length). Such a length of extension 16 assures that the entire height of the distal end of the panel portion 14 is received in the groove 28 of the adjacent module 10. Any excess length of extension 16 due to less severe changes in height of grade 11 can be optionally removed once assembly of the wall is substantially complete. The length of extension 18 (also referred to herein as bottom post extension 18) depends on the structural support needs for a specific building project and will generally be specified in the wall design or specifications. A nominal length of extension 18 is about five feet for an example embodiment but is greater in alternative embodiments to provide greater strength (e.g. for resisting wind loading on the wall of a given height to withstand typical nominal wind velocities of eighty miles per hour).

If desired, internal reinforcement is generally provided as indicated by reference numeral 30. The particulars of reinforcement will typically be designed in accordance with specifications for each given wall installation such that each panel and post module can be supported by the bottom post extension under maximum anticipated adverse weather or impact conditions.

It should be appreciated in this regard that, while panel and post modules 10 are ideally configured to be self-supporting solely through the anchoring of bottom post extension 18 even though the panel portion 14 is cantilevered from the post portion 12, when assembled with other modules (e.g., as illustrated in FIGS. 1 and 2), each wall module 10 will also generally be supported by at least one adjacent wall module 10. This gives a collective stability of many consecutive wall modules which exceeds the stability of a single erect wall module 10 in isolation. This greater collective stability is particularly present under conditions of loading by the fitting of the outermost panel portion edge of a given wall module 10 into the groove 28 of an adjacent wall module 10. This additional support allows reduction of the load borne by the bottom post extension 18 of each respective wall module 10. The extension 18, once installed, as will be discussed below, thus provides a substantial safety margin of structural robustness to resist wind loading and the like. Additionally, being integrally formed, the panel section 14 cannot become detached from the post portion 12 of a wall module 10 even if severe shifting or settling causes detachment/disengagement from an adjacent wall module 10. This has the effect of increasing safety of the completed wall and modules thereof and limiting cost and complexity of required repairs should such shifting or settling occur of be caused by severe conditions. That is, even if the panel portion of a wall module 10 becomes disengaged from an adjacent wall module and is thus wholly cantilevered from the post portion, the anchoring of the bottom post extension 18 prevents the wall portion from failing (e.g., falling).

Figure 2A:
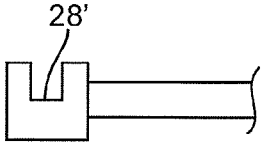
FIG. 2A is a top view of a variant form of the invention.

A variant form of a wall module, an example of which is illustrated in FIG. 2A, allows angular turns to be made in the wall. This allows a serpentine shape in the wall (as seen in plan view) which can greatly enhance the strength of the completed wall as well as permit wall modules 10 to be used for retaining walls and habitable or storage structures as alluded to above. The angle at which an adjacent panel is accommodated can be varied at will in accordance with any desired design and is not limited to the exemplary 90° illustrated. As a further variant embodiment, a groove 28' as shown in FIG. 2A can be provided in addition to groove 28 for using a post and panel wall module 10 as a buttress to further enhance wall strength and stability and possibly acoustic effectiveness.

With further reference to FIG. 1, the anchoring of wall modules 10 sufficient to support the wall modules 10 through extension 18 will now be discussed. It should be understood that walls such as are used for acoustic barriers are largely free-standing and thus require particularly robust and rigid anchorage extending for a substantial depth, e.g., of twenty-five feet or more into the ground. Early designs of such acoustic barriers using steel beams as posts could be driven into the ground using pile drivers or the like and additional required length provided by welding additional lengths of steel beams thereto as the beams were driven into place.

However, for structural reasons, the greater rigidity of pre-cast reinforced concrete later became the structure of choice for posts even though additional length (e.g., the sum of the required depth into the ground and the height of the wall design) could not be produced on site and presented severe difficulties of transportation of posts to the wall construction site. To solve the transportation problem and provide additional wall strength and stability, concrete piers having greater mass and weight than the bottom portions of pre-cast posts became the design of choice since the concrete piers (often referred to somewhat incorrectly as "caissons") could be manufactured on-site or in-situ by inserting a pre-assembled reinforcement cage with substantial bolts integrally formed therewith into a post hole that could be drilled into undisturbed soil and the concrete pier or caisson poured in place. The posts could then be attached to the bolts and thus to the concrete pier or caisson using a flange integrally formed with the posts and the joint between the pier or caisson and the post embedded in concrete by a further in-situ pour. Even though the use of the flange contributed an additional expense and the labor involved in affixing the flange to the pier or caisson using bolts, some economies were achieved since posts and reinforcement cages were then of lengths that could be accommodated by trucks of common design.

In some embodiments, a concrete pier or caisson 20 is formed by placing a reinforcing cage 22 in a post hole in the known manner but pouring the concrete pier or caisson only to the depth to which the bottom post extension 18 will reach and leaving a length 24 of the reinforcement cage substantially equal to the length of extension 18 exposed. The bottom post extension 18 can then be lowered into the space within the exposed reinforcing cage portion 24 as the wall module 10 is set in place. The location of module 10 is then preferably supported in the correct position by temporary structures as well as by interlocking with groove 28, 28' of the adjacent module. Then the concrete pier or caisson is completed by an additional concrete pour 26 which preferably reaches substantially to grade level. The pour 26 is thus precisely complementary to the bottom post extension 18 and becomes substantially integral therewith due to inclusion of the reinforcement cage 22 surrounding extension 18. The bonding to extension 18 and pier or caisson 20 may be enhanced through surface treatment of the extension 18 and/or use of commercially available bonding agents which can be applied thereto in liquid form, although the potential benefit thereof is not believed to be significant relative to the strength obtained through the final structure itself. Once pour 26 has been allowed to cure for a suitable period of time (e.g., several days), the temporary support can be removed and the installation of a given wall module is complete.

It should be appreciated that the assembly and construction technique described above not only provides a structure of increased rigidity, robustness and stability, but does so using modules and reinforcement cages which need not be of a length to require special equipment for transportation. For example, numerous wall modules 10 may be carried in a stacked configuration or with the panel portions (which generally extend about five to eight feet) oriented vertically on a flatbed truck. Further, it should be appreciated from the cross-sections of the integral post and panel module shown in FIGS. 3 and 4 that the modules 10 can be easily, rapidly and inexpensively cast by any of a number of techniques familiar to those skilled in the art, including extrusion, battery molds and/or so-called slip form casting. Moreover, it should also be appreciated that the wall assembly and construction technique described above also allows a progressive sequence of operations to be performed which can be completed in substantially reduced time and with minimized movement of equipment; allowing significant reduction of costs as will now be explained with reference to FIG. 6.

In FIG. 6, an example assembly and construction technique of a wall is depicted as proceeding from right to left. Accordingly, the earliest step is depicted at the left and the sequence of operations at a given location should be considered as being depicted from left to right as denoted by the time sequence indicators T1-T7. Generally, each operation in the sequences T1-T7 is performed by a specialized crew that performs the same operation at a sequence of locations along the route of the wall being constructed with each crew being followed by another crew specialized and equipped for performing the next operation in the sequence.

The process shown in FIG. 6 begins with preparation of a post hole which will include an enlarged portion 61 and a drilled portion 62 which extends to a substantial depth in undisturbed soil and well past any so-called freeze line or depth as depicted at sequence T1. At sequence T2, a reinforcement cage 22 (FIG. 1) is lowered into the drilled hole 62 and properly positioned relative to the walls thereof. Then, at sequence T3, the concrete pier or caisson 20 is poured in-situ, as alluded to above, to a level which can be substantially reached by extension 18. Alternatively, operations T2 and T3 can be combined using a pre-cast concrete pier or caisson fabricated such that a portion of the reinforcement cage protrudes therefrom by a distance substantially equal to the length of extension 18. In this case, concrete can be poured prior to and around the pre-cast pier or caisson to obtain the correct vertical location thereof. However, this alternative requires handling of much increased weight and substantially critical positioning and is thus not preferred. In either case, it is preferred to provide an adequate time interval prior to completing the assembly and construction sequence for adequate curing of concrete pour 20 (or pours incident to positioning a pre-cast concrete pier or caisson).

When the concrete thus poured has cured sufficiently, an integrated post and panel module 10 is placed such that bottom post extension 18 is positioned within the exposed portion 24 of reinforcement cage 22 as alluded to above and as indicated at sequence T4. Positioning of the currently placed module 10 is facilitated by inserting the distal end 42 of the panel portion 14 into groove 28 on a previously placed module 10' as indicated by arrow 64 although such insertion or even previous installation (or, possibly, merely positioning) of an adjacent module as indicated at sequence T5 are not required in all implementations. Then, at sequence T6, the concrete pier or caisson is completed with extension 18 embedded therein by a further concrete pour 26, as alluded to above. It should be noted that it is not necessary for any panel portion to enter the ground and a substantial gap may be permitted between the bottom of the panel portion and the existing grade (since substantial noise attenuation will be achieved at ground level by vegetation or the like). In some cases, however, it may be desirable for part of the panel portion to be below grade, possibly for support in addition to or in place of any temporary support structure such as scaffolding 65 which may be provided to support the modules 10 during curing of pour 26 as shown at 66. Once pour 26 has sufficiently cured, supports 65 can be removed and the wall portion to the right of operation sequence T7 is complete although any excess height 67 of extension 16 can be optionally removed.

According to the aforementioned exemplary embodiments and features, there is provided not only a wall structure of improved robustness and stability but also convenient manufacture and transportation and reduced cost of field assembly which can be performed in much reduced time and much reduced required machinery and movement thereof.

However, for many soil types, reinforcement of the caisson (e.g., with a reinforcement cage 22) can be omitted if the bottom post extension 18 is of a length to extend the full required depth of the caisson. Specifically, referring now to FIG. 7, a further exemplary embodiment is depicted in a manner similar to FIG. 1 and the same reference numerals used in FIG. 1 are applied to corresponding portions of FIG. 7. The embodiment of FIG. 7 differs from that of FIG. 1 principally in the increase in length, D, of the bottom post extension 18 to the full required post depth and spacing for the desired wall height (e.g., twenty-five feet as alluded to above) for the soil type at the location of the wall installation. Reinforcement of the post and panel module may be similar to that discussed above but is preferably continued substantially throughout the post portion of the module and can be pre-stressed over the entire post length. Thus, when installation is complete, the reinforcement effectively provides a substantial degree of reinforcement for the caisson, as well. Otherwise, all features discussed above apply equally to the embodiment of FIG. 7 and need not be repeated in regard to this embodiment of the invention.

Figure 7:
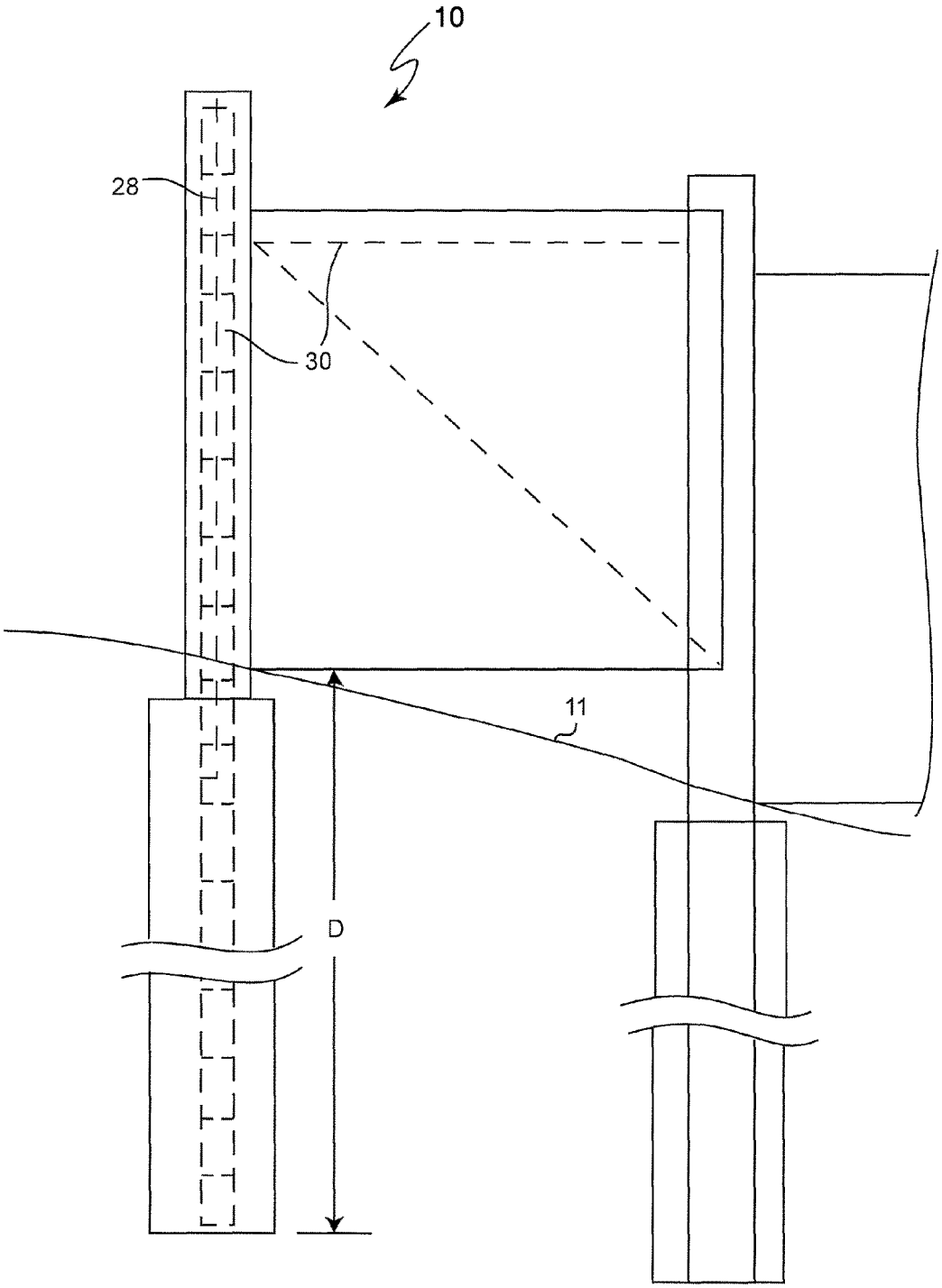
FIG. 7 is an elevation view of another embodiment of the invention allowing further simplified construction.

It should be appreciated that the strength of the wall assembled using the embodiment of FIG. 7 will be of somewhat increased robustness and resiliency due to the continuous reinforcement of the bottom post extension over the entire depth of the installation. Stability will be at least as great as that of the embodiment of FIG. 1 since the weight and dimensions of the completed caisson will be substantially the same if designed for the same type of soil. The embodiment of FIG. 7 can be manufactured in the same manner as the embodiment of FIG. 1 and, unless the desired wall height is more than about thirty feet, can be accommodated on flat bed trailers of commercially available dimensions for transportation in the manner described above while no fabrication or transportation of reinforcement cages is required since the reinforcement cage of the embodiment of FIG. 1 is not needed or used in the embodiment of FIG. 7. Omission of the reinforcement cage also reduces the cost of the embodiment of FIG. 7 in comparison with the embodiment of FIG. 1. Thus, the advantages of the embodiment of FIG. 1 will all be enhanced to some degree in the embodiment of FIG. 7.

Figure 8:
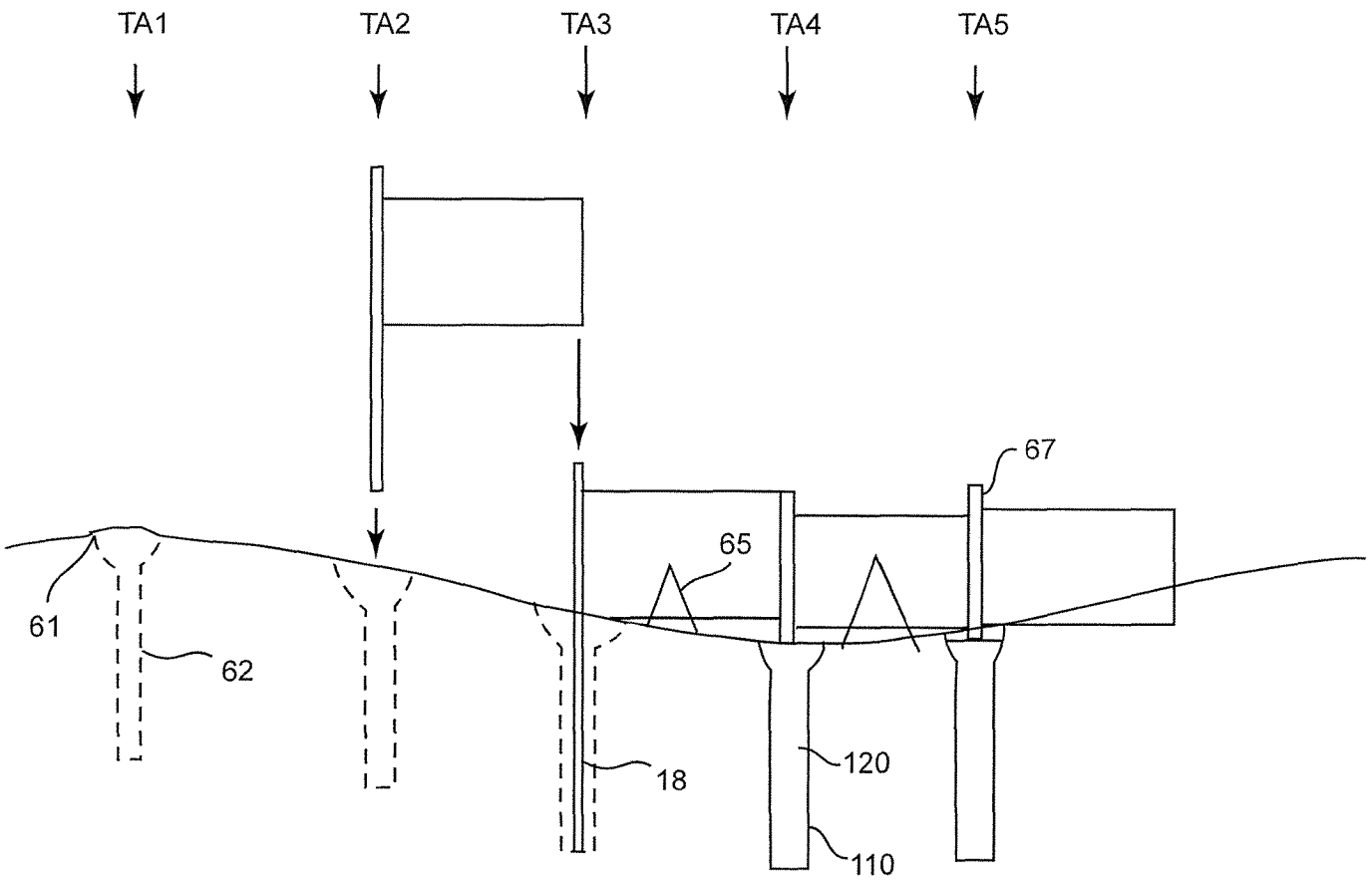
FIG. 8 illustrates the simplified construction procedure provided by the embodiment of the invention illustrated in FIG. 7, FIGS. 9A-9E illustrate a method of constructing a modular wall according to further embodiments.

The principal advantage of the embodiment of FIG. 7 over that of FIG. 1 is in the simplification of wall construction and installation and the consequent reduced time required to do so as will be apparent from a comparison of FIG. 8, illustrating construction and installation of the embodiment of FIG. 7. As with FIG. 6, the process steps for installation for a given panel and post module proceeds from left to right in FIG. 8 as indicated by the time sequence TA1-TA5 while the exemplary wall construction process, as illustrated, proceeds from right to left.

As shown at time TA1 of FIG. 8, the installation process begins, as in the embodiment of FIG. 1, with the digging of a post hole 62, preferably by drilling in view of the depth that may be required. The post hole diameter is determined based on soil type and load bearing qualities (e.g., compressibility) to develop sufficient surface area to bear against the soil when anticipated loads are placed on the panel section. The upper portion 61 of posthole 62 is preferably enlarged somewhat, as before, to provide increased bearing surface against the surrounding soil where forces due to wind and the like will be increased. Once a satisfactory post hole is formed, the panel and post module 10 may be set in place as indicated at TA2, to engage slot 28 of a previously installed module (or a starting terminal post) and alignment adjusted and secured with bracing 65, as illustrated at TA3. Then, the caisson 110 can be formed, preferably in a single concrete pour 120 into the post hole 61, 62 to surround the lower post portion extension 18 as illustrated at TA4. So-called self-consolidating or self-leveling concrete is preferred since it does not require compaction and tends to form a better bond with the post portion of the wall module and a better quality interface with the surrounding soil. Once the concrete has cured sufficiently, bracing 65 can be removed and the installation of the post and panel module is complete.

It should be appreciated from a comparison of FIG. 8 with FIG. 6 that the embodiment of FIG. 7 simplifies the process by essentially allowing the installations stages T2 and T3 of FIG. 6 to be omitted. However, it should be appreciated that the process illustrated in FIG. 6 requires two separate concrete pours and corresponding curing times while the process of FIG. 8 requires only a single pour and curing time. Thus, the time elapsed between processes TA2 (after the post hole is formed) and TA5 of FIG. 8 is only about one half of the duration between operations T2 and T7 of FIG. 6.

Perhaps more importantly, the period of time from when the post hole is formed to the concrete pour for the caisson (e.g. TA2 to TA4; the period personnel are engaged in placement of a post and panel module) is very short and, since the bracing 65 can be removed at any time after the concrete cure is complete, (assuming that a separate crew will be forming the post holes since a post and panel module can be set in place in far less time than is required to form a post hole) requires only a single crew and a single set of machinery. In contrast, assuming the wall is relatively long, the corresponding period in FIG. 6 stretches from T2 to T5 and, for most rapid construction, requires a minimum of two crews, working several days apart, and two sets of machinery for the process of FIG. 6. Therefore, using the embodiment of FIG. 7, wall installation and construction can proceed much more rapidly with fewer personnel and less machinery, realizing a substantial cost savings in addition to saving the cost of manufacturing and transporting reinforcement cages required in the embodiment of FIG. 1. Both the exemplary embodiments of FIG. 1 and FIG. 7 provide a major simplification of construction and reduction in construction time and labor over a wall design constructed from separate posts and panels.

FIGS. 9A-9E illustrate a method of constructing a wall with further advantageous features as compared to the method illustrated in FIG. 8 and described with respect thereto. The embodiment illustrated in FIG. 8 shows, for example, an extension 18 of a wall module extending substantially to the bottom or floor of the post hole at TA3. For some wall installations, however, advantages arise from the provision of a space or gap between the distal end of the extension 18 (i.e., the distal end of the post portion of the wall module 10) and the base or floor of the post hole. In other words, distinct advantages arise from the suspension of the bottom post extension within the post hole. In general, a suspended extension 18 will be free of contact from the bottom as well as all surrounding sides of the post hole.

One advantage of a suspended extension 18 (i.e., a suspended post portion) is that a pier can in effect be formed beneath the terminal end of the post portion after the space is filled with concrete which is then cured. Another advantage of a suspended extension 18 is a possible reduction in the required length of the extension 18. This means the pre-fabricated wall module 10 can be shorter in some embodiments which facilitates easier transportation from the prefabrication site to the installation site. Of particular advantage to the suspension of the post portion in the post hole is a greater ease and capability of adjustment in the position of the wall module 10 prior to anchoring the module by filling the remaining spaces in the post hole with wet concrete or the like which is then permitted to cure. This advantage will be described in greater detail below.

FIGS. 9A-9E illustrate an exemplary method for constructing a wall with modules of integrated panel and post, the method including suspension of the post portion, in particular the bottom post extension thereof, within the post hole. Similar to the embodiments discussed in connection with FIGS. 6 and 8, the installation process generally begins with the digging of a post hole 90 as in FIG. 9A, preferably by drilling in view of the depth that may be required. The post hole 90 extends to a substantial depth in undisturbed soil and well past any so-called freeze line or depth. The post hole diameter is determined based on soil type and load bearing qualities (e.g., compressibility) to develop sufficient surface area to bear against the soil when anticipated loads are placed on the panel section. An exemplary post hole diameter is 30 inches, for example. If desired, the upper portion of post hole 90 can be enlarged somewhat, as in FIGS. 6 and 8, to provide increased bearing surface against the surrounding soil where forces due to wind and the like will be increased. The post hole is generally formed as one of a series of post holes, one hole for each of a plurality of consecutive wall modules.

Figure 9A:
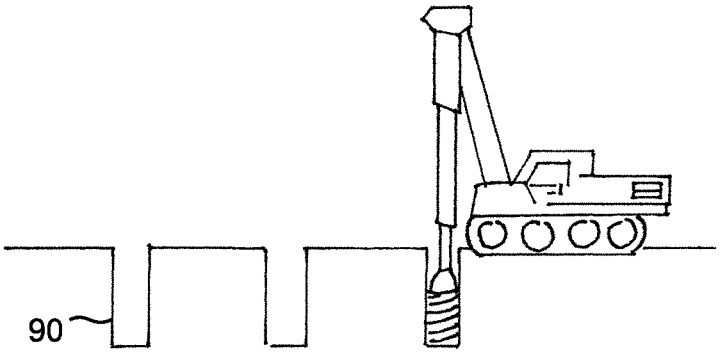
Figure 9B:
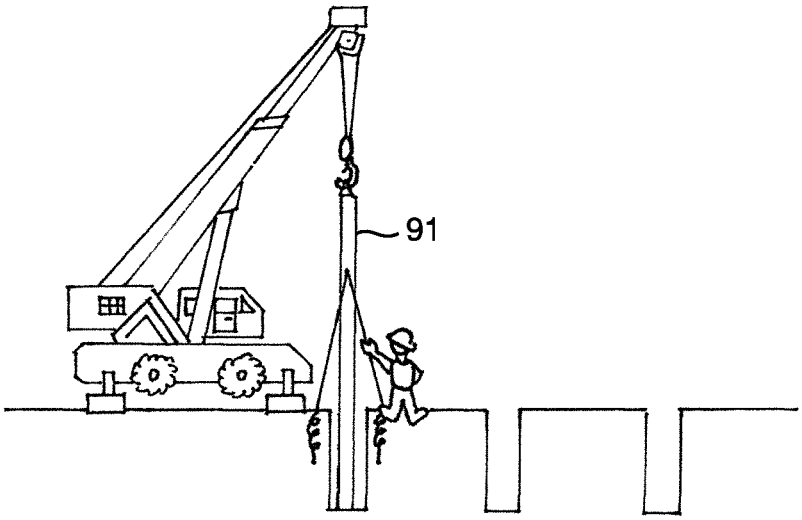
Figure 10:
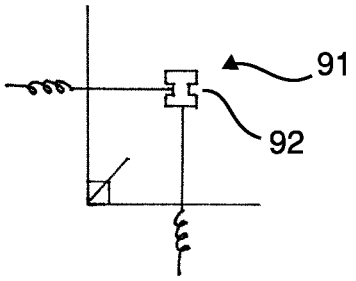
FIG. 10 is a plan view of the terminal post of FIG. 9B, FIGS. 11A-11C illustrate alternative braces for temporarily supporting and aligning a wall module.

Once a satisfactory post hole 90 is formed, the wall can be started by erecting a terminal post 91 as shown in FIG. 9B. The terminal post 91, shown in a top plan view in FIG. 10, includes one or more grooves 92 having generally the same sizing and configuration as grooves 28 or 28' discussed above with respect to previous embodiments. In general, the terminal post 91 can be anchored by means such as two braces set at, for example, 90° with respect to one another, as illustrated schematically in FIG. 10. Exemplary braces for aligning and supporting the terminal post 91 includes those illustrated in FIGS. 11A-11C, described below. While it is possible to align wall modules 10 with only a single brace (e.g., brace 111, 111', 111", or similar), it is generally necessary to brace a terminal post 91 with two braces (e.g., two instances of brace 111, 111', 111", or similar).

Figure 9C:
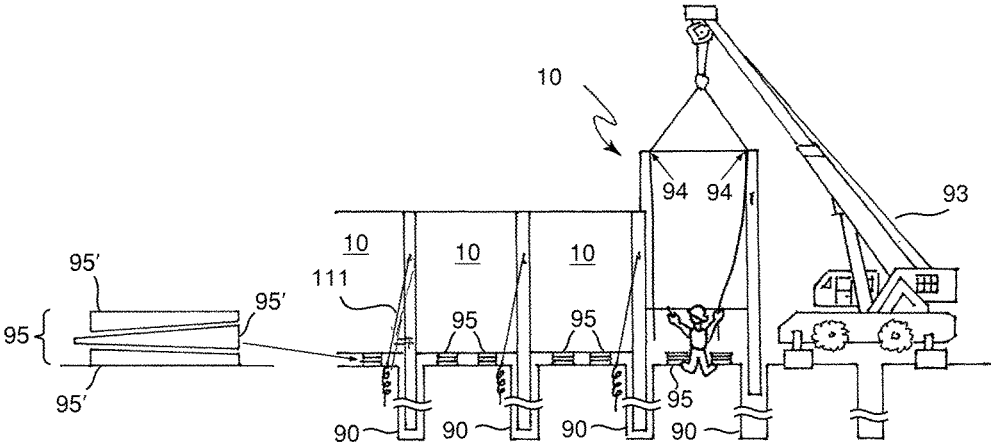

After the terminal post is established, wall modules 10 are positioned consecutively therefrom. FIG. 9C illustrates the positioning of a single wall module 10. In general, each wall module 10 is erected and installed as part of the wall in substantially the same manner, regardless of whether the module is the first in the sequence (i.e., immediately adjacent to the terminal post), the last in the sequence, or somewhere in between. A crane 93 is used to lift the wall module 10 at connections 94. Advantageously, the wall module 10 can be lifted and released using only the crane 93 and personnel on the ground, as illustrated in FIG. 9C. Ladders and man lifts are not necessary. A feature of the construction method of this illustrated embodiment is the use of one or more load bearing members 95 which are arranged under the panel portion of each wall module 10. In FIG. 9C, two load bearing members 95 are employed per wall module 10. The wall module 10 is positioned on top of the load bearing members 95 with the load bearing members arranged under the panel portion specifically. The load bearing members 95 and the module 10 are positioned with respect to one another such that the load bearing members 95 vertically support the wall module 10 at a sufficient height to suspend a distal end of the post portion of the wall module within a post hole. The suspension of the post portion in the post hole is illustrated in FIG. 9C for each of the three visible modules already in their respective positions atop load bearings members 95.

In an exemplary embodiment, the one or more load bearing members 95 each consists of multiple tapered cribbing boards 95' arranged as stacked sets such as is illustrated in the enlarged partial view at the left side of FIG. 9C. While the load bearing members can all be the same height, such as is shown in FIG. 9C, this is not required in all implementations. In some circumstances, one or more load bearing members have different heights from one or more of the remaining load bearing members. This can be desirable when, for example, the load bearing members are arranged on uneven ground and load bearing members of different heights are used to level the bottommost edge of the panel portion with respect to horizontal.

In FIG. 9C, the wall modules 10 are not yet anchored. The post portions are suspended within respective post holes 90, generally without contact with any sides and certainly without contact with the floor of the post hole. Briefly referring back to FIG. 9A, The post hole should be formed to a depth which is greater than the difference between i) the height of a load bearing member and ii) the length of a bottom post extension extending past a bottommost edge of the panel portion. The space or gap (element 136 in FIG. 13) between the terminal end of the post portion and the floor of the hole is at least 6 inches, for example. In some embodiments, the space or gap is 6 to 12 inches. For example, the space or gap may be 6 inches, 7 inches, 8 inches, 9 inches, 10 inches, 11 inches or 12 inches. A space or gap of at least 6 inches ensures adequate material (e.g., concrete) can be poured into the hole and provided under the terminal end of the post portion of the wall module 10 to provide exemplary support and anchoring in the earth after the concrete has set. The gaps between the sides of the post hole and the sides of the post portion within the hole is also several inches in some embodiments. For example, an exemplary post hole diameter is 30 inches. The gaps between the sides of the post portion and the walls of the hole is at least 3 inches, 3-12 inches, at least 6 inches, or 6-12 inches, for example.

In this unanchored state, each wall module 10 is preferably braced. Bracing is particularly advantageous when supplied in a transverse direction (e.g., with forces supplied on the wall module in a direction substantially perpendicular to the surface of the panel portion). While multiple braces can be employed, cost, materials, and time are saved by employing only a single brace for each wall module 10.

Figure 11A:
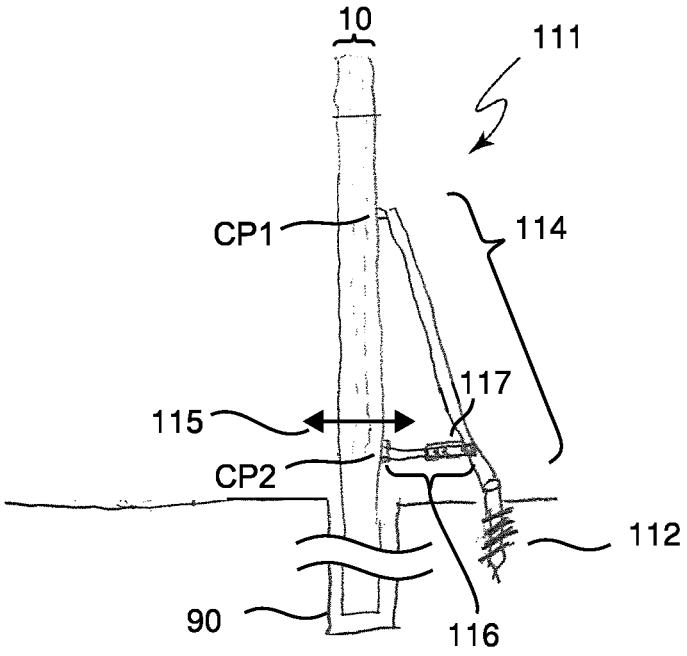
Figure 11B:
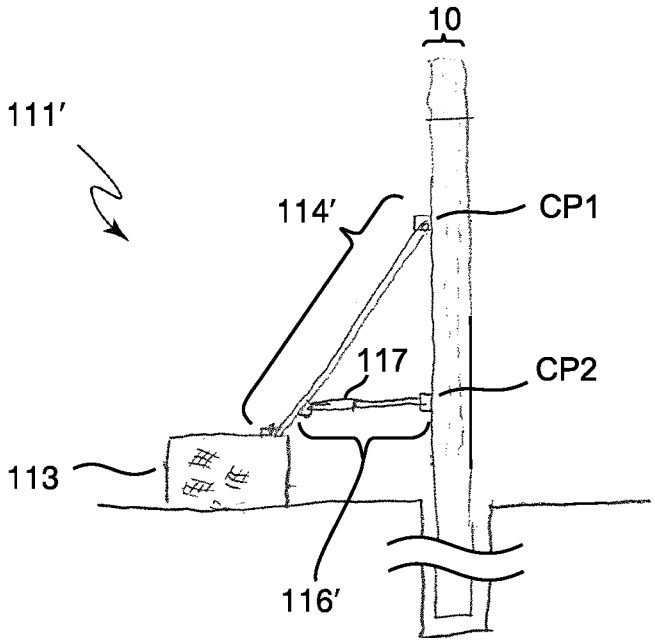
Figure 11C:
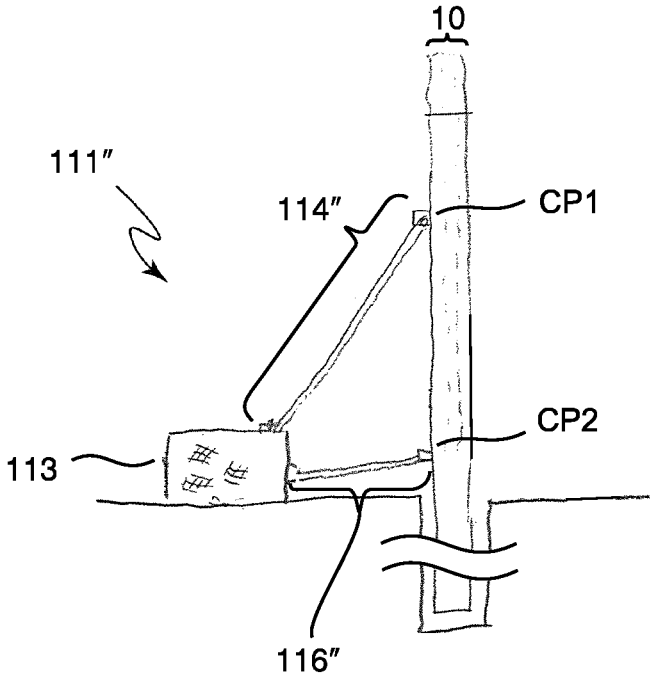

FIGS. 11A-11C show three alternative exemplary braces which are usable for supporting a single wall module 10. In a preferred embodiment, an exemplary brace 111, 111', or 111" has at least two points (e.g., just two points; two or more points) of contact with a wall module. The first contact point CP1 is higher than the second contact point CP2. Each brace is itself anchored either by a heavy duty or industrial earth anchor 112 or by a moveable weight 113 (also, referred to in the industry as a "dead man" or "deadweight"). In general, the brace 111, 111', 111" is reversibly fixed to the wall module at contact points CP1 and CP2 by a mechanical connection such as a bolt. Both contact points are preferably on the post portion (as opposed to the panel portion) of the wall module 10.

FIG. 11A shows an exemplary brace 111 for providing temporary support to a wall module, comprising a primary elongate member 114 and a second elongate member 116. The primary elongate member 114 is configured at one end for removable attachment to the wall module 10 at the first contact point CP1 and, at an opposite end, anchorage with respect to the ground (e.g., using earth anchor 112). In general, the primary elongate member is linear. The second elongate member 116 is of adjustable length and is configured at one end for removable attachment to the wall module 10 at the second contact point CP2. At the opposite end, the second elongate member 116 is attached to the primary elongate member 114 at a location between the two ends of the primary elongate member 114.

Figure 12:
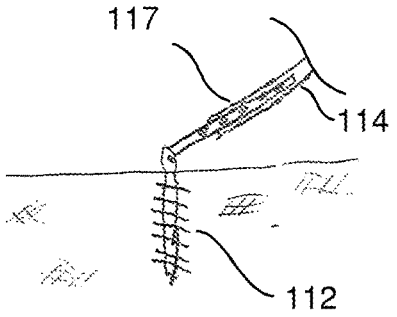
FIG. 12 is a view of a deep earth anchor and portion of a brace.

The primary elongate member 114 is either a fixed predetermined length or, alternatively, is adjustable in length. In the example embodiment of FIG. 11A, primary elongate member 114 has a fixed length. Alternatively, FIG. 12 shows an enlarged partial view showing a deep earth anchor 112 and a length changing mechanism 117 near the end of the primary elongate member 114 for adjusting the length of the primary elongate member 114. According to an exemplary configuration, at least the second elongate member 116 has a length changing mechanism 117 that permits length adjustment of the second elongate member 116 while the second elongate member is attached to both the wall module 10 and the primary elongate member 114. Increasing or decreasing the length of the second elongate member 116 permits fine adjustment of the position (e.g., the vertical alignment) of the post portion of the wall module 10 within the post hole 90.

FIG. 11B shows a brace 111' which includes a primary elongate member 114' and a second elongate member 116'. In contrast to brace 111 (FIG. 11A), brace 111' has at one end of the primary elongate member 114' a moveable weight 113 instead of an earth anchor 112. This configuration is generally desirable when the ground is unconducive for an earth anchor, such as when the ground is stone. Any brace can be arranged on the left side or, alternatively, the right side of a wall module.

FIG. 11C shows a brace 111" which includes a primary elongate member 114" and a second elongate member 116". The two elongate members meet at and/or are connected via the anchor (e.g., in this example the moveable weight 113). This contrasts with the configurations of braces 111 and 111' (FIGS. 11A and 11B, respectively) in which the second elongate member is connected/attached to the primary elongate member at a position that is in between the two ends of the primary elongate member.

Figure 13:
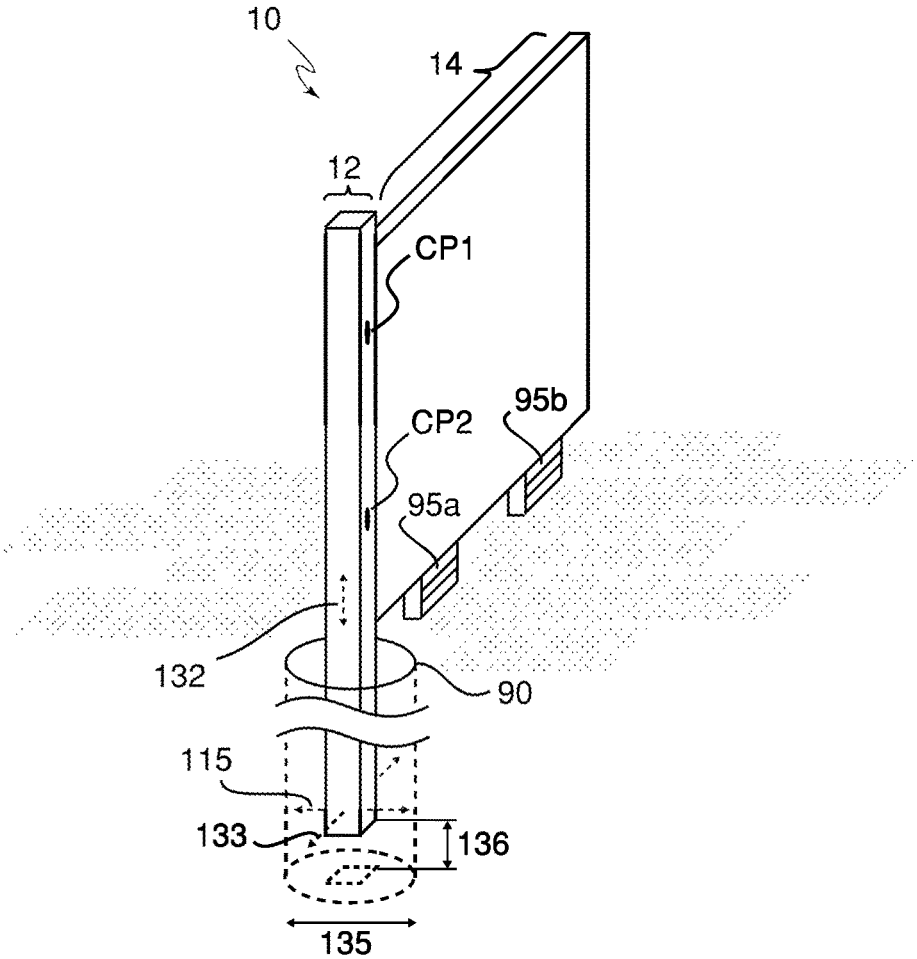
FIG. 13 is a diagram of a suspended wall module in perspective view.

FIG. 13 illustrates aspects of adjusting the vertical alignment of a wall module 10 and, in particular, the post portion 12 of the wall module 10. The position and vertical alignment of the wall module 10, and in particular the vertical alignment of the post portion 12, is changed by adjusting a position of the first contact point CP1 with respect to the second contact point CP2 in three dimensional space. The position of the wall module 10 is further adjustable by changing the height of load bearing member 95*a* with respect to load bearing member 95*b*, and vice versa. In FIG. 13, the terminal end of the post portion 12 is shown suspended within a post hole 90. The position of the terminal end of the post portion 12 is adjustable along any one, two, or three different mutually orthogonal spatial axes which are respectively labeled 115, 132, and 133. Vertical alignment of the post portion 12 includes aligning the post portion 12 with respect to the post hole 90. An exemplary vertical alignment includes aligning the post portion 12 so that it is substantially coaxial (e.g., its center longitudinal axis is coaxial) with the post hole 12 (e.g., with the center longitudinal axis of the post hole). The diameter of the post hole 90 is indicated at 135. Note that grooves in the post portion which are ordinarily present have been excluded from the illustration of FIG. 13 for clarity.

Axis 115 is referred to herein as the transverse direction. The terminal end of the post portion 12 can be moved in the transverse direction (e.g., left or right on the page according to FIG. 13) by an adjustment to the length of the second elongate member 116 of a brace 111 (see FIG. 11A). Adjustment of the position of the second contact point CP2 has no effect or negligible effect on the position of the terminal end of the post portion 12 along axis 132 or axis 133. In other words, a brace 111 (and other braces as disclosed herein) advantageously allows adjustment of the position of the terminal end of the post portion 12 along just one of the three orthogonal spatial axes. Adjustment of the position in the transverse direction is isolated from the two other orthogonal spatial axes/directions.

Adjustment of the position of the terminal end of the post portion 12 along axis 132 or 133 is predominantly if not entirely controlled by the weight bearing members 95*a* and 95*b*. Axis 132 is referred to as the vertical direction (e.g., up or down with respect to the ground; also up or down on the page in FIG. 13). Equally increasing or decreasing the height of the weight bearing members 95*a* and 95*b* has the effect of raising or lowering the terminal end of the post portion, respectively. Changing the position of the terminal end of the post portion 12 along axis 132 changes the size of the space or gap 136 between the terminal end of the position portion 12 and the floor of the hole 90. For improved clarity of the relative positions of elements, FIG. 13 shows in broken lines a projection of the terminal end of the post portion 12 onto the floor of the hole 90.

Axis 133 is referred to as the lateral direction (e.g., into or out of the page in FIG. 13). Adjustment of the position of the terminal end of the post portion 12 along axis 133 is controlled by an adjustment in the relative heights of weight bearing members 95*a* and 95*b* with respect to one another. An increase in the height of member 95*b* with respect to 95*a* (i.e., a decrease in the height of member 95*a* with respect to 95*b*) causes the terminal end of the post portion 12 to move in one lateral direction (e.g., into the page according to FIG. 13). A decrease in the height of member 95*b* with respect to 95*a* (i.e., an increase in the height of member 95*a* with respect to 95*b*) causes the terminal end of the post portion 12 to move in the opposite lateral direction (e.g., out of the page according to FIG. 13).

It can be immediately appreciated from FIGS. 11A-11C that the distance between the two contact points CP1 and CP2 is constant for a given wall module (although the distance may vary for different embodiments). However, the alignment of CP1 and CP2 in three dimensional space is variable. For example, from the perspective in FIG. 11A, it is possible to adjust the position of CP2 left or right, as indicated by arrow 115, while the position of CP1 remains substantially the same. Arrow 115 represents the transverse direction with respect to the wall module 10, the panel of which extends into the page according to the perspective shown in FIG. 11A.

Figure 9D:
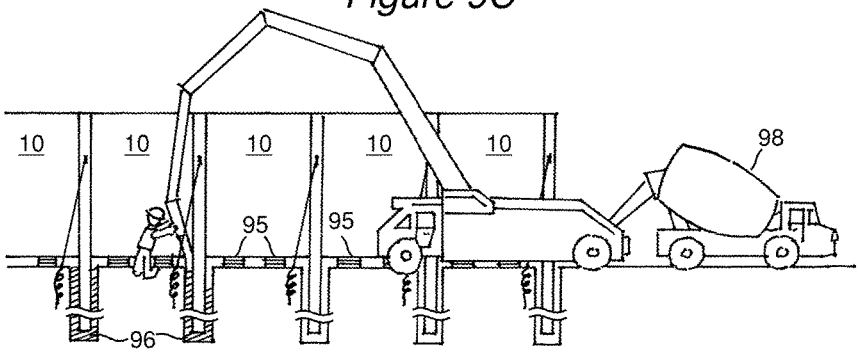

The installation process continues as in FIG. 9D after a wall module is positioned in the final desired orientation (e.g., with respect to the earth, with respect to the post hole, with respect to adjacent wall modules or a terminal post). In some embodiments, if desired, the wall module 10 is provided with containment steel (e.g., containment steel hoops) on the post portion initially at or near the position on the post portion corresponding with the bottom edge of the panel portion (i.e., at the top of the post portion extension 18). A suitable number of containment steel hoops is six, for example. The containment steel is pushed down into the hole for the top 3 to 4 feet, for example, for additional stability and support.

Continuing with FIG. 9D, with the extension 18 in its desired final position and alignment, material 96 is poured into the post hole 90 such that the material 96 fills space between the distal end of the post portion and a bottom of the post hole and spaces between sides of the post portion and sides of the post hole. In general, the material 96 is concrete, a concrete-bonded aggregate, or the like. The material 96 can be pumped into the post holes or caissons directly from a ready-mix truck 98. It is preferred that all positioning of the wall module 10 is performed prior to any uncured concrete is poured into the post hole. However, if needed, some adjustment of position may be possible while the concrete is still wet and uncured. It is advantageous for all the material 96 (e.g., concrete) for a single post hole to be poured in a single step and then permitted to cure. The pouring step forms a pier or caisson integral with the bottom post extension 18.

Figure 9E:
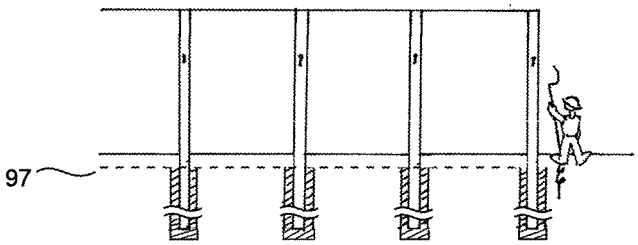

FIG. 9E shows the final step of installation, namely to remove temporary support elements. Braces 111, 111', or 111" can advantageously be removed by personnel on ground level without the use of ladders or lifts. In general, brace removal only requires disconnecting the brace from the wall module at each of the contact points CP1 and CP2. According to some exemplary methods, the load bearing members 95 are temporary and are also removed after the concrete in the post hole has cured, securely anchoring the entire wall module in the earth. Stacks of tapered cribbing boards, as discussed above, are particularly useful as temporary load bearing members since they can be removed simply. The removed load bearing members in such case may be reused if desired. In FIG. 9E, the load bearing members have already been removed and the ground surface regraded up to or above the bottom edge of the panel portions of the wall modules. Regrading is optional, as it is generally the case that foliage can provide an adequate sound barrier at the base of completed wall. The dashed line 97 indicates the ground level prior to regrading.

As an alternative to removing temporary load bearing members, the load bearing members may be permanent and left in place. The ground is regraded to the level of the bottom of the panel portion or above the level of the bottom of the panel portion. In such case, the load bearing members may be covered by top soil.

While the construction of a modular wall as described above in connection with FIGS. 9A-9E involved starting the wall with a terminal post 91, this approach is simply an exemplary embodiment. As an alternative, a modular wall can be assembled using a wall module 10 as the first installed piece. In this scenario the terminal post 91 is the final element installed (i.e., after all of the consecutive wall modules 10 have been installed in their positions).

Modular walls may include any combination of wall modules described herein. The method of installing any such modular wall may furthermore include a combination of the methods or method steps of installation described herein. For instance, a modular wall may include some wall modules 10 which have suspended post portions (e.g., as in FIG. 9E) and some other wall modules 10 which have post portions which extend to the floor of the post holes (e.g., as in FIG. 8). Alternatively, some modular walls may have wall modules 10 all of which have suspended post portions.

In view of the foregoing, it is seen that post and panel wall modules for construction of a wall provide substantial economies in both production and installation. In the manufacturing of the post and panel module, there is simplified casting forms or equipment, substantial economies of transportation of the modules to the construction site and even further economies in assembly and construction of walls through enabling use of a single sequence of operations which can be completed quickly and with minimal equipment and movement thereof. Moreover, exemplary embodiments provide a completed wall of superior robustness, strength, stability, and safety while minimizing costs of repairs which may be caused by settling, shifting or damage, particularly as applied to walls which form an acoustic barrier.

It should be appreciated that certain reference numbers herein are used in multiple embodiments to refer to similar but not necessarily identical structures or features. In particular, reference numeral 10 is used to refer to all wall modules which comprise both a wall or panel portion and a post portion. Other specific features described with respect to a wall module 10 may be optionally included or excluded from wall modules 10 of other embodiments or implementations in the practice of the invention. That is to say, the specific groupings of features described herein, especially with respect to wall modules 10 and their methods of use in constructing modular walls, are exemplary combinations only. Other combinations which "mix and match" features of different exemplary embodiments described herein may occur to those of skill in the art and are generally within the purview of the invention. While the invention has been described in terms of several exemplary embodiments, those skilled in the art will recognize that the invention can be practiced with modification within the spirit and scope of the appended claims.

Having thus described my invention, what I claim as new and desire to secure by Letters Patent is as follows:

1. A method of constructing a modular wall, the method comprising:

using concrete wall modules each comprising a panel portion integrally formed of concrete with and cantilevered from a post portion;

suspending a distal end of the post portion of a concrete wall module within a post hole without contacting a floor of the post hole while the concrete wall module is vertically aligned and supported, wherein space between the distal end of the post portion and a bottom of the post hole is empty space, and wherein the suspended distal end is the end of the post portion extending furthest into the post hole;

arranging one or more load bearing members under the panel portion of the concrete wall module to provide vertical load bearing support and maintain the concrete wall module, including the post portion, at a predetermined height; and pouring a material into the post hole such that the material fills the space between the distal end of the post portion and the bottom of the post hole and spaces between sides of the post portion and sides of the post hole.

2. The method of claim 1, further comprising forming the post hole as one of a series of post holes, one hole for each of a plurality of consecutive concrete wall modules.

3. The method of claim 2, wherein the post hole is formed to a depth which is greater than the difference between i) the height of a load bearing member arranged under the panel portion of the concrete wall module to provide vertical support and ii) the length of a bottom post extension extending past a bottommost edge of the panel portion.

4. The method of claim 1, further comprising bracing the concrete wall module in a transverse direction to assure the vertical alignment.

5. The method of claim 4, wherein the bracing is performed using a single brace having two points of contact with the concrete wall module, one point of contact being higher than the second point of contact, the single brace being anchored in earth or supported by a deadweight.

6. The method of claim 5, further comprising adjusting a position of the first contact point with respect to a position of the second contact point in three-dimensional space such that a position of a terminal end of the post portion is adjusted along one, two, or three different mutually orthogonal spatial axes.

7. The method of claim 1, further comprising arranging the one or more load bearing members as stacked sets of tapered cribbing boards.

8. The method of claim 1, further comprising removing the one or more load bearing members after the material poured into the post hole has cured.

9. The method of claim 1, wherein the material poured in the pouring step is concrete.

10. The method of claim 9, wherein the concrete wall module is fully positioned in its final vertical orientation prior to any uncured concrete being poured into the post hole.

11. The method of claim 9, wherein all concrete for a single post hole is poured in a single step and then permitted to cure.

12. The method of claim 1, wherein the post portion includes a groove for receiving a distal end of a panel portion of an adjacent module such that the panel portion of the adjacent module is supported to relieve stress from a post portion of the adjacent module that is due to the panel portion being cantilevered therefrom.

13. The method of claim 12, further comprising positioning the concrete wall module in such a way that a distal end of the panel portion is received in the groove of an adjacent concrete wall module.

14. The method of claim 1, wherein the concrete wall module further includes a top post extension for accommodating the entirety of the distal portion of the panel portion of an adjacent module when the adjacent module and the wall module are installed at different heights.

15. The method as recited in claim 1, further comprising positioning the concrete wall module so that part of the panel portion is below grade.

16. The method of claim 1, wherein the empty space between the distal end of the post portion and a bottom of the post hole is at least 6 inches.

* * * * *